United States Patent [19]

von Schuckmann

[11] Patent Number: 4,538,747

[45] Date of Patent: Sep. 3, 1985

[54] DISPENSER FOR THE PORTIONED DISPENSING OF, IN PARTICULAR, PASTY MASSES

[76] Inventor: Alfred von Schuckmann, Kervendonk 63, 4178 Kevelaer 2, Fed. Rep. of Germany

[21] Appl. No.: 573,749

[22] Filed: Jan. 25, 1984

[30] Foreign Application Priority Data

Jan. 29, 1983 [DE] Fed. Rep. of Germany ..... 3303002

[51] Int. Cl.[3] ..... G01F 11/00

[52] U.S. Cl. ..... 222/260; 222/340; 222/387

[58] Field of Search ..... 222/256, 260, 340, 383, 222/386, 387, 518

[56] References Cited

U.S. PATENT DOCUMENTS 2,305,158 12/1942 Hanses ..... 222/260
4,323,175 4/1982 Eckert ..... 222/387
4,402,431 9/1983 Wiegner et al. ..... 222/260
4,485,943 12/1984 Czech ..... 222/256

FOREIGN PATENT DOCUMENTS 2916206 11/1980 Fed. Rep. of Germany .
3104726 8/1982 Fed. Rep. of Germany ..... 222/386

*Primary Examiner*—H. Grant Skaggs
*Attorney, Agent, or Firm*—Martin A. Farber

[57] ABSTRACT

A dispenser for apportioned dispensing of material, particularly pasty masses. The dispenser has a piston which travels within the dispenser storage chamber toward a mouthpiece dependent on actuating steps. A slide is displaceable toward the mouthpiece by an actuating handle. The slide is guided in sealed fashion by a lip. The slide includes a wing which, upon an actuating stroke, comes in sealing fashion against the wall of an ejection channel and upon a return stroke lifts away from the wall of the ejection channel. The wing is flat in shape, and forms one resiliently movable leg of the slide. The slide is V shaped, with the V tip facing the piston, and extending into the material.

12 Claims, 10 Drawing Figures

DISPENSER FOR THE PORTIONED DISPENSING OF, IN PARTICULAR, PASTY MASSES

BACKGROUND AND FIELD OF THE INVENTION

The present invention relates to a dispenser for apportioned dispensing of material, in particular, pasty masses, having a piston which travels within the dispenser storage chamber in the direction towards a mouthpiece, in accordance with the actuating steps, and a slide which is displaceable by an actuating handle in the direction towards the mouthpiece. A lip sealingly guides the slide to the dispenser housing. The slide also has a wing which, upon the actuation stroke, comes against the wall of an ejection channel in a sealing manner. Upon a return slide the wing lifts away from the wall.

A dispenser of this type is known from West German OS No. 29 16 206. In that case the slide is guided in an ejection channel which is arranged transverse to the storage chamber. The storage chamber and ejection channel are in flow communication via a passageway. The slide which delivers the apportioned quantity has, on its mouthpiece side, a wing in the form of an annular cuff. The latter is oblique so that a ring-funnel which widens in the direction of delivery is present. By acting on an actuating handle associated with the slide, the separated portion which lies in front of the wing is forced out through the opening of the mouthpiece. The pressure which is thus produced displaces a valve, which otherwise closes the mouthpiece opening, out of its closed position. This valve is a centrally located plug-like closure piece which is urged in closing direction by a spring. Upon the pressing out of the portion, the piston of the storage chamber, which follows in the direction towards the mouthpiece corresponding to the actuating steps, is pulled along. The slide is furthermore sealed off by a lip lying on the other side of the passageway. This lip moves along the wall of the ejection channel and, like the cuff forming the wing, is of annular shape. After the dispensing of the apportioned quantity, the slide moves back under spring action into its basic position. The wing in this connection moves over the mass lying behind it, releasing its sealed application against the corresponding wall of the ejection channel and therefore moving somewhat radially inward. After reaching the basic position, the wing again moves out into its blocking position. This apparatus is not only too difficult to produce as a mass-production article, but it also requires a precision which is excessively great for a mass-production article. In this regard, the rigidity of the wing must be adapted to the force of the valve spring. If for example the valve spring is too hard then the rigidity of the cuff collapses. There will then be disturbances in the dispensing delivery. If, on the other hand, the rigidity of the cuff is made greater, it no longer travels over the mass which is to be pulled along next. The function depends too greatly on the degree of viscosity of the mass. From a structural standpoint, furthermore, the transverse position of the ejection channel with respect to the storage chamber is disadvantageous insofar as problems in injection molding arise there. Furthermore, finally, the number of parts is too great.

The object of the present invention is to develop a dispenser of this type which is simpler to manufacture and more advantageous to use in the manner that, on the one hand, a special valve on the mouth side can be dispensed with while the filling column nevertheless is retained free of interruption until the delivery of the last portion, and all of this with considerably fewer parts in such a dispenser.

SUMMARY OF THE INVENTION

This object is achieved by utilizing a wing which is of flat shape and forms one resiliently moveable leg of a slide which is of V-shape, with the vertex of the V-shape facing the piston, and the slide extends into the material to be dispensed.

As a result of this development, there is obtained a dispenser which is of great reliability in operation and is simple to manufacture; the afore-mentioned precise adaptation is no longer required. Furthermore, the need for a separate valve on the mouth side is eliminated, since the flexible movable wing itself provides a valve function. In effect the slide is a type of scoop with swingable removal surface. In addition the entrance movement of the slide in the mouthpiece results in a useful suction effect so that no residue remains on the mouthpiece side. The wing, which is developed in flat shape, forms in simple fashion one leg of the V-shaped slide which penetrates into the mass and has its V-vertex facing the piston. The V shape favors the entry into the mass, particularly as the acute-angle of the V shape is further reduced upon the downward pushing. The V leg of the slide which moves only linearly passes in sealing fashion through a slot in the cover of the storage housing. Stationary guiding sealing lips acting on the V leg of the slide or guiding sealing lips provided on the slide itself lie in front of the wing in the direction of dispensing. In the case of guiding sealing lips provided on the slide, the development is such that one lip is guided on the wall of a recess while the other, which lies on the other side of the slide V-leg, is guided on a correspondingly parallel extending deeper-drawn section of a wall on the ejection channel side. These correspondingly parallel extending walls thus form a guide shaft (the slot) for the slide which penetrates into the mass. The dispensing mechanism can therefore directly adjoin the storage chamber. A separate transverse chamber is no longer required.

For the actuation of the slide, the slide passes into a double-armed actuating key in the region above the cover. One advantageous feature of the slide is that it and the actuating key are formed integral with each other, namely in one piece. The actuating surface of the key extends substantially transverse to the dispensing path of the filling material. As a result of the fact that the inside dimension of the ejection channel is greater in cross-section than that of the mouthpiece, the mass present in the mouthpiece for all practical purposes itself provides a valve function since, as a result of its consistency and friction, the mass does not permit leakage of air. The ejection channel is advantageously located coaxial to the mouthpiece. Furthermore, transverse arms of the recess which extend from wall to wall form a resting surface for the curved return spring of the actuating key. The return spring rests against the ends of these arms. It is accordingly supported in a manner which favors sliding. If a sliding movement is to be dispensed with, an alternate embodiment provides a return spring, which is pre-arched in the direction of the ejection channel, and extends downwardly from the outer end of the double-armed actuating key. Its free end rests in the lower inner corner of the recess on the ejection-channel side. Upon tilting movement of the key, the spring arches in a in the direction of the bending point between the slide and the actuating key.

The object of the invention is explained in further detail below, with reference to two illustrative embodiments shown in the drawing, in which:

DETAILED DESCRIPTION OF THE PREFERRED EMBODIMENTS

Figure 1:
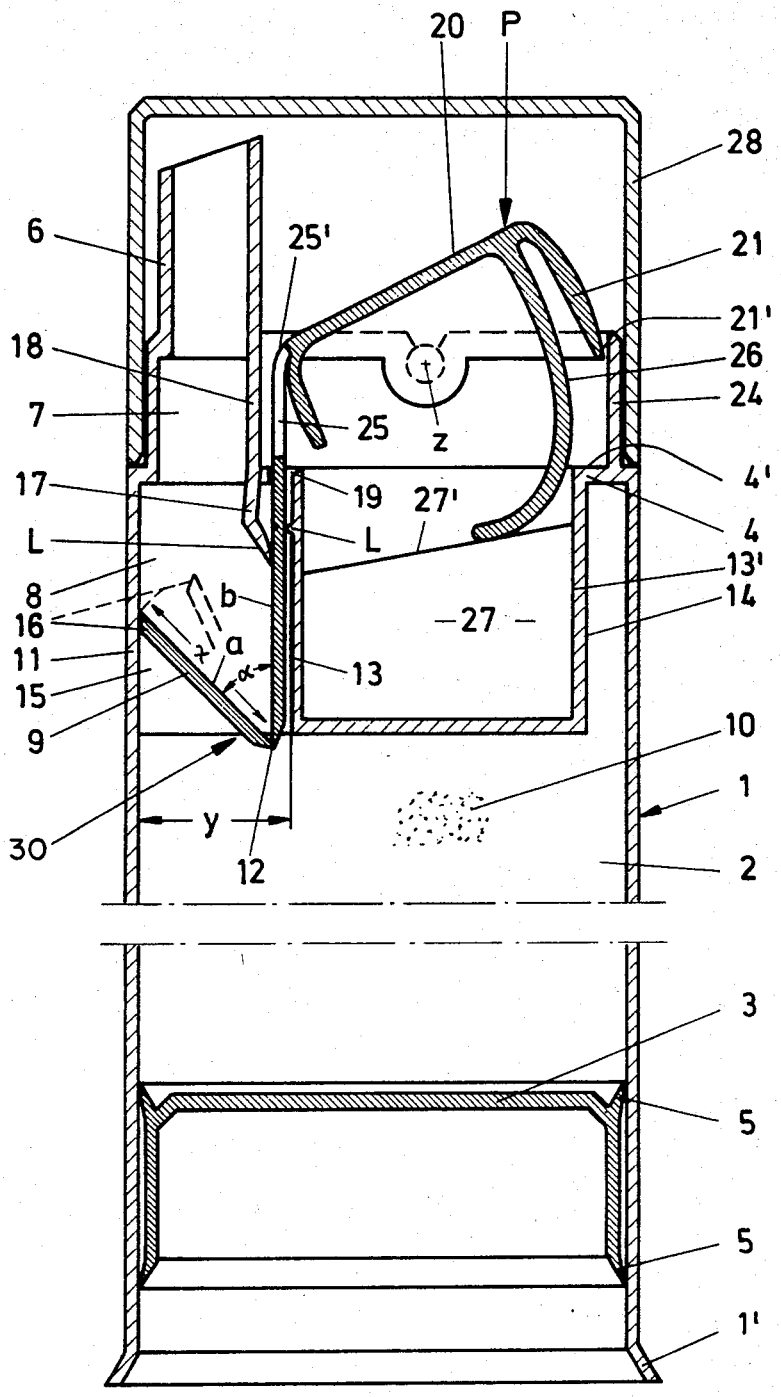
FIG. 1 is a vertical section through the dispenser of the invention with the dispensing mechanism in its basic position, in accordance with the first embodiment.
Figure 2:
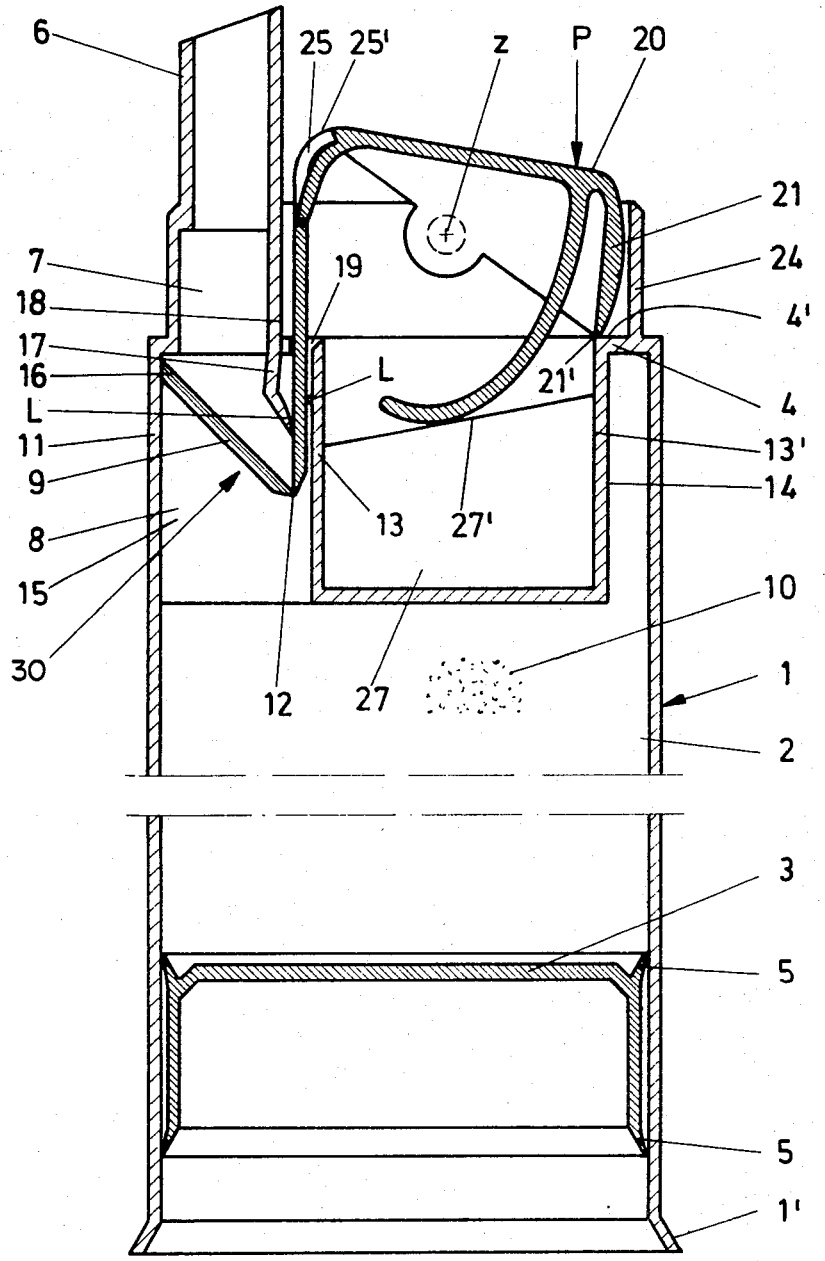
FIG. 2 is a sectional view corresponding to FIG. 1, but actuated for dispensing.
Figure 3:
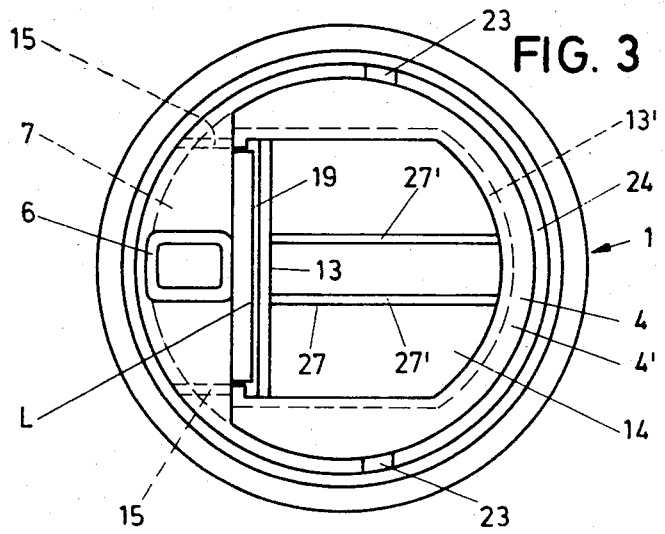
FIG. 3 is a top view of the dispenser with the slide removed.

The dispenser of both embodiments has a cylindrical storage housing 1. Its storage chamber 2 is closed at the bottom by a piston 3 which moves in the direction towards the cover 4 of the storage housing 1 in accordance with the actuating steps. In order to receive the piston 3, the storage housing 1 is open at the bottom. A funnel-shaped flaring of the lower housing edge 1' facilitates the insertion of the piston after the filling.

The piston is pot-shaped. The edges of the pot and the bottom zone each form an annular sealing lip 5. The top lip serves as scraping lip and the housing-edge lip serves as a supporting lip and for this purpose has a greater clamping force.

The cover 4 bears a mouthpiece 6. The latter is arranged eccentrically. It extends in the form of a small tube of rectangular cross section from a chamber section 7 of segmental shape, as seen in cross section, which also extends above the cover 4. The chamber section 7 has about four times the passage cross-section of the mouthpiece 6.

Adjoining the chamber section 7, as seen in the direction of the storage chamber 2, there is an ejection channel 8. The latter is coaxial to the mouthpiece. The free inside dimension of the ejection channel 8 is greater in cross-section than that of the mouthpiece 6 and slightly greater than that of the chamber section 7.

The ejection channel 8 receives a vertically displaceable slide 30. The slide is of V shape. Its shorter V-leg a is developed as a wing 9. Upon the actuating stroke for the purpose of apportioned dispensing of the filling content, in this case a pasty mass 10, the wing 9 lies in sealing fashion against a wall 11. Upon the return stroke, on the other hand, it moves away from the wall 11. The corresponding hingeability is obtained with a so-called film hinge 12 by which the wing 9, which is of flat shape, is connected with the linearly movable longer V-leg b. The latter rests against the outer surface of a wall 13 of a recess 14 which extends from the cover 4. The wall 13 serves to form part of the ejection channel 8 and lies parallel to the vertical wall 11. The recess 14 is continued on the side towards the ejection channel in vertical, also parallel, narrow walls 15 which also laterally limit the shaft. These narrow walls commence in the wall of the storage housing 1.

The length x of the wing 9 is greater—seen in the plane of swing—than the width dimension y of the ejection channel 8 lying in this direction. The dimensional relationship is such that an acute angle $\alpha$ of 45° is present, for instance, between the legs a and b of the V. The V-vertex lies in the region of the wall 13. The narrow edge 16 (end surface) of the wing 9 is beveled in such a manner that a contact surface with the wall 11 is formed which is wider than the thickness of the wing. Rounded in accordance with the cylindrical course of the wall of the storage housing 1 and of the wall of the integrated ejection channel 8, which wall assumes a corresponding partial course.

In the basic position shown in FIG. 1, the V-vertex of the slide 30 extends somewhat beyond the lower edge of the ejection channel 8. The sealing of the slide towards the outside is obtained in the case of the embodiment shown in FIGS. 1 to 5 by guiding and sealing lips L arranged fixed in position. In the embodiment of FIGS. 6 to 10, on the other hand, these sealing lips L are seated on the slide 30, i.e. on its V-leg b.

In the first embodiment, a first guiding and sealing lip L is located on the wall 13 of the recess 14. It is developed there over the entire width of the channel as a ridge of triangular cross section which lies transversely to the direction of displacement, one side of the triangle being seated as base on the wall 13. The other guiding and sealing lip L for the slide 30 rests against the ejection-channel side surface of the V leg b, extending also over the entire width of the ejection channel 8. This sealing lip is seated on a lug 17 of freely resilient development which extends downward beyond the cover 4. Lug 17 adjoins an inner-sidewall 18 of the chamber section 7. The lip L terminates tapered in blade-like fashion and extends also at an acute angle substantially parallel to the wing 9 but at a distance therefrom in the direction of the mouthpiece which permits the required actuating stroke. Spatially, this stationary guide sealing lip L extends from upper left to bottom right, starting from the vertical lug 17. The wing 9 extends from bottom right to top left.

In the second embodiment (see FIG. 10), the guiding and sealing lips, which are developed also as ridges of triangular cross section, are also seated with their one wide side as a base so that the vertexes of the triangles extend transversely to the plane of movement of the slide. The guide sealing lips L lie in such a manner that one lip L which is on one side of the V-leg b is guided along the wall 13 of the recess 14 while the other guiding and sealing lip L, which is on the other side of the V-leg b, is guided on the deeper-drawn section of the ejection channel sidewall 18. The two walls extend parallel to each other and thus form a guide shaft for the slide 30.

The V-leg b of the slide which is limited to linear movement passes in sealing fashion through a slot 19 in the cover 4, which slot is widened somewhat in upward direction. The size of the slot and that of the guide shaft adjoining it on the bottom are so selected that between the recess-sidewall 13 and the ejection-channel-sidewall 18 such a width remains that the slide can be introduced there with the wing 9 swung against it and the wing, after leaving the lower lying guide sealing lip L, comes into the position shown in the figures by elastic movement as a result of its resiliency.

Above the cover 4 the V-leg b of the slide 30 passes, in accordance with both embodiments, into an actuating key 20. This key is developed as a double-armed lever. It is a part of the slide 30 which is stiffened by a shell-like edge wall 21. From this edge wall 21 there extend diametrically opposite stub shafts 22 (see FIG. 4) which are clipped into bearings 23 of an annular wall 24 of the storage housing 1 which extends above the cover (see FIG. 3).

Figure 5:
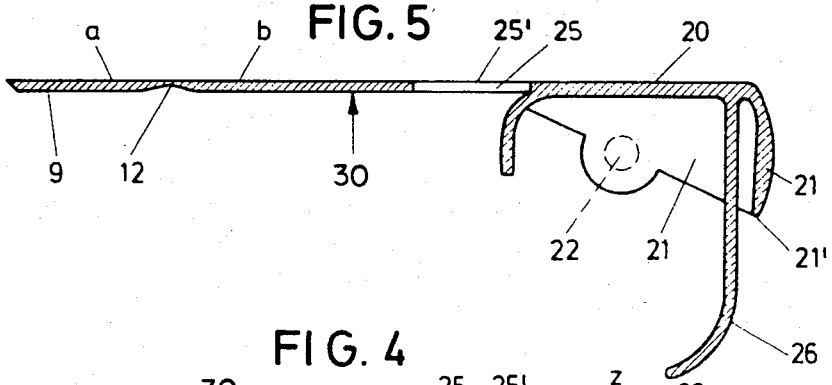
FIG. 5 is a section along the line V—V of FIG. 4.
Figure 4:
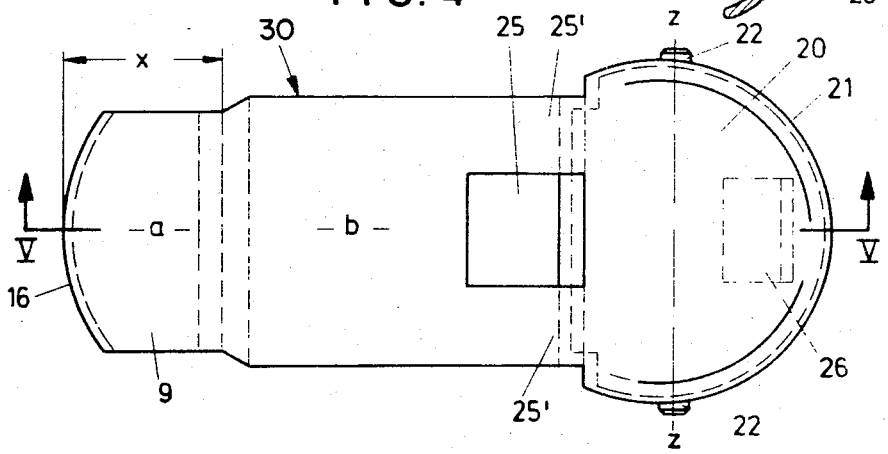
FIG. 4 is a top view of the slide with actuating key in the mold-removal condition, shown in detail.
Figure 10:
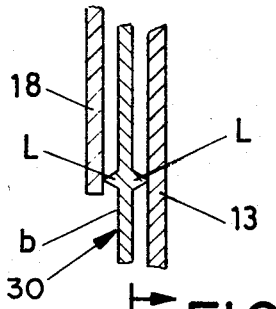
FIG. 10 is a detailed enlarged view of the slide having the guide sealing lips.
Figure 8:
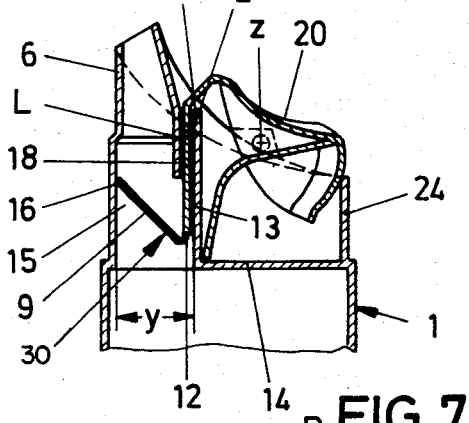
FIG. 8 is a sectional view corresponding to FIG. 7, but actuated for dispensing.
Figure 6:
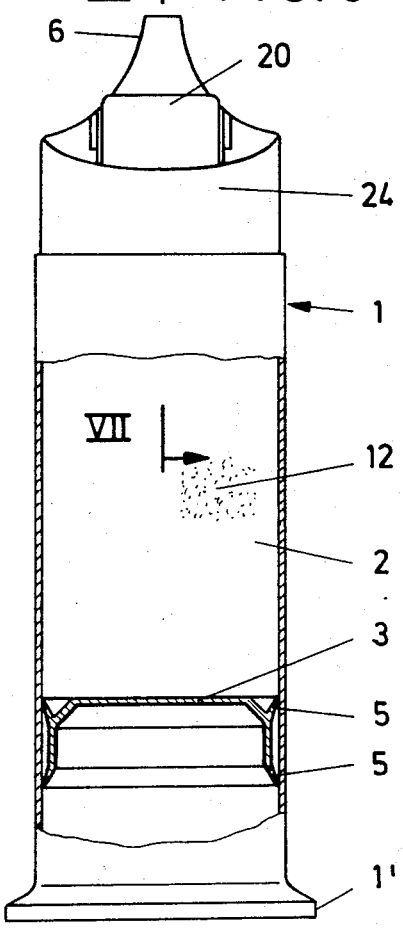
FIG. 6 is a view of the dispenser of the second embodiment, seen from the actuating-key side, partially broken away.
Figure 7:
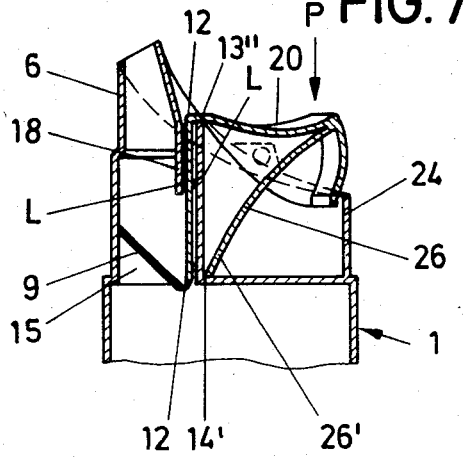
FIG. 7 is a section along the line VII—VII of FIG. 6, with the delivery mechanism in its basic position.
Figure 9:
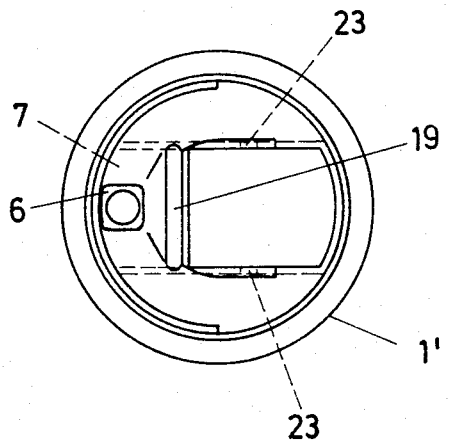
FIG. 9 is a top view of FIG. 7 (without actuating key)

The actuating key 20, which is developed integrally or in one-piece with the slide, when removed from its mold has the shape shown in FIGS. 4 and 5. When assembled with the dispenser, on the other hand, the V-leg b extends vertically and the portion forming the actuating key 20 extends bent off at an angle substantially transverse thereto at the transition place between chamber section 7 and mouthpiece 6 in ascending direction. In order to obtain an articulation (or bending) zone which bends more easily, a window-like opening 25 is located in the transition zone between the actuating surface of the rocker-like actuating key 20 and the V-leg b. Said opening lies in the middle region so that stays 25' remain on the right and on the left. The opening-forming zone is cut free in the form of a tongue so that it protrudes approximately vertically from the actuating surface. It therefore extends approximately parallel to the edge wall 21 of the actuating key 20. To this extent it acts as skirt covering the lower region of the actuating key 20.

On the other side of the actuating-key pivot axis Z formed by the sutb shafts 22, a bent return spring 26 extends from the lower side thereof. It is at the same time formed thereon and acts in such a manner that the slide assumes the dispensing-ready position shown in FIG. 1. The return spring rests on the end edges 27' of the recess-side arms 27. The latter lie in the plane of tilt of the actuating key. They extend in parallel from the recess-wall 13 which forms the support for the slide up to the opposite wall 13' thereof. As can be noted from FIG. 1, the upper end edges 27' of the arms 27 extend obliquely downward in the direction of the ejection channel 8.

The limitation of the stroke is obtained by a stop on the actuating-key side, in the manner that the cover-side front edge 21' of the longer section of the edge wall 21 strikes against the top side 4' of the cover 4 lying on the other side of the return spring. The corresponding position can be noted from FIG. 2. As can be seen, the wing has not yet come against the step formed by a reduction in cross section between ejection channel 8 and chamber section 7. In the dispensing actuating position shown in FIG. 2, the return spring 26 has clearly moved out of the position substantially parallel to the longest section 21' of the edge wall 21 into a definitely spread-out position. The return force results in the bringing of the actuating key, and thus the slide, back into the position shown in FIG. 1. The longest section 21' is diametrically opposite the narrow edge 16.

In the second embodiment, the return spring 26 is not arranged in sliding association with the recess; rather, the return spring 26, which is slightly pre-arched in direction of the ejection channel 8, extends from the outer end of the double-armed actuating key 20 so that its free end 26' rests against the lower inner corner 14' of the recess 14, located on the ejection-channel side. It thus passes substantially diagonally through the recess. In the basic position (FIG. 7), the return spring 26 holds the actuating key 20 in limiting application against the upper end-surface 13'' of the wall 13. As can be seen, that end of the double-armed actuating key 20 which lies in the vicinity of the film hinge 12 rests there. The direct region adjoining the film hinge 12 on the slide side is deformed slightly under the actuation of the push key. Due to the flexibly movable plastic material used, deformation of this region can be permitted.

The manner of operation of the two embodiments is briefly as follows: The storage housing 1, which is filled up to the mouthpiece 6 is ready for the portioned dispensing of the pasty mass 10 after removal of a protective cover 28 which covers the mechanism. For this purpose, pressure is exerted on the actuating key 20 in the direction indicated by the arrow P. This leads to the displacement of the slide 30 in the direction towards the cover 4. The pasty mass which is present in front of the wing 9 is thereby pushed out of the mouthpiece 6. The guide sealing lip L which lies in front of the wing 9 in the direction of delivery scrapes off the pasty material present there so that it cannot emerge through the slot 19. The mass to be delivered furthermore acts in such a manner on the delivery-side surface of the wing 9 that the sealing application against the wall 11 is not eliminated. By this all-sided sealing the piston 3 is pulled along over the filling column of pasty mass 10 to which it for all practical purposes "sticks."

The reinsertion of the slide takes place without greater load on the pasty mass as a result of the acute-angle immersion thereof, the wing 9, tilting around the film hinge point 12, swinging inward in the direction of the V leg b. The slide thus enters into the mass 10 and scoops up the next portion. The resiliency of the material effects again the application of the wing 9 in the manner of a blocking valve against the wall 11. The next portion can be removed, etc.

The pasty mass present in the spout-like mouthpiece tube acts as a plug which reliably closes off from the outer air and even moves into the mouthpiece 6, avoiding any residue, which might possibly dry out rapidly.

The slight protrusion of the slide or its lateral opening into the directly adjacent storage space 2 favors the keeping of the partial quantity present in the ejection chamber 8 moist.

I claim:

1. In a dispenser for apportioned dispensing of material, including a dispenser housing, a mouthpiece, a storage chamber for the material, a piston arranged to travel within the storage chamber in a direction toward the mouthpiece in dependency on dispensing actuation steps, an actuating handle, a slide displaceable by said handle toward the mouthpiece, lip means arranged for sealingly guiding the slide to the housing, an ejection channel connected to the mouthpiece, and a wing arranged to come in sliding contact against a wall of said ejection channel during an actuating stroke and to move away from the wall of the ejection channel during a return stroke, the improvement wherein:

said wing is flat, said slide is V-shaped, said wing forms one resiliently moveable leg of said V-shaped slide, the vertex of said V-shaped slide points toward said piston, and said slide extends into said material.

2. The dispenser according to claim 1, wherein:

said housing includes a cover for said housing, said cover being formed with a slot;

said actuating handle comprises a double-armed actuating key; and wherein a second leg of said V-shaped slide linearly movably extends through said slot in operatively sealed manner and is operatively articulated with an end portion of said actuating key.

3. The dispenser according to claim 2, wherein said slide and said actuating key are formed is one-piece.

4. The dispenser according to claim 3, wherein said lip means comprises a plurality of fixedly arranged guiding and sealing lips for the operative sealing of said second leg with respect to said slot.

5. The dispenser according to claim 4, wherein said cover has a recess wall forming a recess in said cover for said housing, said lips comprise:

a first guiding and sealing lip for said second leg arranged on said recess wall; and a second guiding and sealing lip arranged to lie on the other side of said second leg extends at an acute angle with respect to said recess wall.

6. The dispenser according to claim 5, further comprising a curved return spring formed integrally with said actuating key, and at least one arm extends from said recess wall and forms a resting surface against which said curved return spring engages.

7. The dispenser according to claim 6, further comprising a plurality of said arms extends from said recess wall to an opposite recess wall of said cover, said recess walls form said recess therebetween.

8. The dispenser according to claim 3, wherein said housing has a recess wall, said ejection channel is formed by walls, one of the latter is a deeper-drawn wall of the ejection channel and is parallel to said recess wall, said recess wall and said deeper-drawn wall form therebetween a guide shaft communicating with said slot, said second leg of said V-shaped slide linearly movably extends through said guide shaft, said lip means comprises, a plurality of guiding and sealing lips for sealing said second leg with respect to said guide shaft and thereby for the operative sealing of said second leg with respect to said slot, said guiding and sealing lips are on said second leg of said slide and comprise:

a first lip guided movably along said recess wall in said housing, and a second lip guided movably along said deeper-drawn wall of the ejection channel.

9. The dispenser according to claim 2, wherein said housing forms a recess, a return spring is pre-arched in the direction of the ejection channel and extends downwardly from an outer end of said double-armed actuating key and a free end of said return spring rests in a lower inner corner of said recess on a side adjacent said ejection channel.

10. The dispenser according to claim 1, wherein the free inside dimension of said ejection channel is larger in cross-section than the free inside dimension of said mouthpiece.

11. The dispenser according to claim 10, wherein said ejection channel is coaxial to said mouthpiece.

12. The dispenser according to claim 1, wherein said lip means comprises, a plurality of fixedly arranged guiding and sealing lips for the second leg.

* * * * *